US008888511B2

(12) United States Patent
Ma

(10) Patent No.: US 8,888,511 B2
(45) Date of Patent: Nov. 18, 2014

(54) UNIVERSAL POWER SOCKET ADAPTOR

(76) Inventor: Jesse Ma, Gold Coast (AU)

( * ) Notice: Subject to any disclaimer, the term of this patent is extended or adjusted under 35 U.S.C. 154(b) by 53 days.

(21) Appl. No.: 13/579,991

(22) PCT Filed: Dec. 13, 2010

(86) PCT No.: PCT/AU2010/001683

§ 371 (c)(1),
(2), (4) Date: Aug. 20, 2012

(87) PCT Pub. No.: WO2011/054064

PCT Pub. Date: May 12, 2011

(65) Prior Publication Data

US 2013/0052886 A1 Feb. 28, 2013

(30) Foreign Application Priority Data

Nov. 3, 2009 (AU) ..... 2009905359

(51) Int. Cl.

| | |
|---|---|
| ***H01R 4/66*** | (2006.01) |
| ***H01R 27/00*** | (2006.01) |
| ***H01R 24/22*** | (2011.01) |
| *H01R 103/00* | (2006.01) |

(52) U.S. Cl.

CPC ..... *H01R 24/22* (2013.01); *H01R 27/00* (2013.01); *H01R 2103/00* (2013.01)

USPC ..... 439/105; 439/222; 439/652

(58) Field of Classification Search

CPC .... H01R 25/006; H01R 31/06; H01R 13/652; H01R 13/514; H01R 13/055; H01R 13/506; H01R 13/24; H01R 27/00–27/02; H01R 13/35

USPC ..... 439/105–106, 171–173, 652–653, 222, 439/107

See application file for complete search history.

(56) References Cited

U.S. PATENT DOCUMENTS 6,328,581 B1 * 12/2001 Lee et al. ..... 439/106
7,234,954 B1 * 6/2007 Srage et al. ..... 439/222

(Continued)

FOREIGN PATENT DOCUMENTS

GB 2454953 * 5/2009 ..... H01R 27/00

*Primary Examiner* — Xuong Chung Trans

(74) *Attorney, Agent, or Firm* — Dowell & Dowell, PC

(57) ABSTRACT

The invention relates to power sockets and, more particularly, relates to universal power sockets capable of receiving, and electrically engaging with, different types of plugs having pins. Even more particularly, the invention relates to a universal power socket having sprung contacts. There are universal adapters already in existence, however some are unable to connect accurate and stably with a plug. Some may require a different pin clasp to hold it in place, whereas some adapters may be too big, or are not cost effective, and will still be unable to hold a vast range of power plugs. My invention has resolved all of these problems, something which has never previously been done. The creation of my universal adapter has enabled the use of only one clasp in order to hold 9 different pins. It is accurate and will hold power plugs stably in place, with the convenience of being able to connect to a majority of power plugs worldwide. My invention has safely adapted the power plug to be much smaller and convenient with the ease of having a low cost. It can be used for travel as a power adapter, as well as being used as an indoor power socket. The ability to be implanted indoors is beneficial to airports and hotels, where it will be of convenience for their customers who have arrived from a different country.

1 Claim, 5 Drawing Sheets

(56) References Cited

U.S. PATENT DOCUMENTS 7,306,471 B2 * 12/2007 Shau-din ..... 439/171
7,614,892 B2 * 11/2009 Klant et al. ..... 439/172
7,857,640 B1 * 12/2010 Lee et al. ..... 439/137
8,382,493 B2 * 2/2013 Ruffner ..... 439/105
8,702,493 B2 * 4/2014 Nores ..... 463/20
8,753,149 B2 * 6/2014 Lee ..... 439/653

* cited by examiner

UNIVERSAL POWER SOCKET ADAPTOR

BACKGROUND ART

[Mere reference to background art herein should not be construed as an admission that such art constitutes common general knowledge in relation to the invention.]

Since the adoption of electricity, in particular distributed electricity, buildings and houses have been fitted with electrical sockets in which electrical plugs, with pins thereon, can electrically engage with. The electrical socket typically has a switch and provides a point at which appliances and devices and the like can be plugged in to. Typically the socket is 'female' and the plug with pins is 'male, with the pins at least comprising a portion of an electrically conductive material (e.g. a suitable metal).

Over time, sockets, in particular wall sockets, developed, some including various features, usually safety features. Different countries and regions developed different power systems and standards, and also different plug/socket combinations. As far as the plug/socket is concerned, the primary differences are most notable in the pin number (e.g. 2 or 3 pins), shape, and configuration. For example, some countries have plugs with generally flat parallel pins, some with angled pins, some with rounded pins, some with square pins, etc.

The differences in pin number, shape, and configuration makes travelling and moving from one type of plug/socket arrangement to another troublesome. This is because electrical appliances/devices are typically shipped with a single pin arrangement suitable for use in the particular country/region that it is sold. When a person travels or moves from that country/region to one with a different type of plug/socket arrangement, the plugs of their appliances/devices will not fit in to the different shaped sockets.

Some pin configurations are similar, and a simple 'bending' of the pins may allow a plug of one type to fit into another. For example, a plug with generally flat parallel pins may be bent to be at the appropriate angle for insertion into a socket with angled pins. However, the bent pins typically do not make a very secure electrical engagement with the electrical contacts in the socket, which may mean that electricity is either poorly transferred, not transferred, or that arcing may occur (e.g. if there is an air gap between the pin and the contact). Furthermore, because the pins are bent the plug will likely not fit completely into the socket meaning that portions of the pins where the bend is effected (e.g. twisted) will be exposed. This is an electrocution hazard for anyone near the plug, or could also be a fire or short circuit hazard. Additionally, the bending of the pins may damage the pins, particularly if they are bent too many times.

Another option for allowing a plug of one pin configuration to fit into a socket of another, is to fit another plug with the correct pin configuration. Although this may provide a safe and secure engagement with the socket, disadvantageously this is a more permanent solution and it is not feasible to easily switch between different pin configurations such as, for example, when a person is travelling between many different countries/regions with different plug types.

To more easily facilitate the connection of one plug type in to another socket type, pin adapters have been developed. In one form, a pin adapter has a socket that is suitable for connecting the users plug type in to, and has pins that suit a different socket type. However, to allow for connection of the plug to many different socket types, many different adapters are required (i.e. one adapter for each socket type). Furthermore, the adapter of this form can only receive one plug type, and cannot facilitate the connection of different plug types into any given socket.

To overcome this latter mentioned disadvantage of adaptors, some 'universal' adapter with sockets that could receive multiple plug types with different pin configurations were developed. The sockets were shaped to allow a variety of different pin shapes and configurations therein, and to electrically engage with the pins of each configuration. To allow the variety of pin configurations to electrically connect within the socket, the contacts were typically shaped such that they could be engaged with small pins, and also be bendable so that they could be 'pushed out' upon insertion of some of the larger pin types. However, when larger pin types were inserted, particularly if inserted a number of times, the pins would bend back. As the contacts bent back more permanently, they no longer provided a suitable safe electrical engagement with the smaller pin types. Particularly, after the contacts had been bent back the smaller pin types would not electrically connect properly and, for example, may intermittently come in and out of electrical engagement. This is not only prone to arcing, which can cause fires or the like, but also can produce electromagnetic interference. Furthermore, if the plug is not engaged securely, the plug may wobble or, worse, fall out of the socket.

Due to these shortcomings, sockets that allow multiple types of plug therein are generally not accepted for everyday or industrial use. Accordingly, even in areas where it would be highly desirable to allow multiple plug types to be connected, for example in an airport or hotel, the universal sockets are generally not considered safe (e.g. don't meet the requisite electrical standards), and therefore only sockets of the particular country/region are utilised and it is up to the user of different plug types to provide their own, possibly unsafe, adapter to interface between their plug type and the socket of another.

It is an aim of this invention to provide an improved power socket which overcomes or ameliorates one or more of the disadvantages or problems described above, or which at least provides a useful alternative.

SUMMARY OF THE INVENTION

According to an aspect of the invention, there is provided a power socket adapted to receive and connect with power plugs having different pin configurations, the power socket comprising:

a housing having at least two apertures for receiving respective pins of the power plug therein; and a contact associate with each aperture that electrically engages with the respective pin; wherein at least one contact is a sprung contact comprising a spring that applies force substantially perpendicularly to the longitudinal axis of the respective pin.

Preferably the spring is a helical or coil spring that is located between a portion of the housing and one side of the contact, preferably the opposite side of the contact to that which electrically engages with the respective pin. The portion of the housing is preferably shaped to facilitate secure retention of the spring therein, particularly under both relaxed (i.e. extended) and stressed (i.e. compressed) states of the spring. Preferably the spring is in the relaxed state when no pin is received therein, and in a stressed state when a pin is being received therein. Preferably the apertures and contacts are shaped to facilitate insertion of the pin into the aperture and engagement of the pin with the respective contact(s).

The contacts are preferably provided in sets or groups. Preferably the spring contacts are in sets comprising at least opposed pairs, adapted to apply force generally to each side of the respective pin upon insertion therein. A third, non-sprung, contact may be provided perpendicularly adjacent to the two sprung contacts. Preferably the two sprung contacts are angled such that the combination of the sprung contacts and the third non-sprung contact form a generally triangular shape channel for receiving a pin therein. The non-sprung contact is preferably shaped to facilitate secure holding and engagement of different pin shapes and/or configurations. Preferably the non-sprung shaped contact is an elongated 'w' shape. Preferably, each set of contacts securely receives and electrically engages with the respective pin received therein. Preferably each contact in a set of contacts that engage with a respective pin are electrically connected.

Preferably at least two apertures each have at least one sprung contact that comprises a spring that applies force substantially perpendicularly to the longitudinal axis of the respective pin. Even more preferably, three apertures are provided, with only two of the apertures having sprung contacts that comprise a spring, and the third aperture having non-sprung contacts. Preferably the apertures associated with the two sprung contacts are adapted to receive pins that are electrically active and/or neutral, and the third aperture associated with non-sprung contacts is adapted to receive an earth/ground pin.

The aperture and contact(s) adapted to receive an earth/ground pin may be optional, as many power plugs are two pin only and do not have a third earth/ground pin. Nevertheless, preferably an aperture and contact(s) adapted to receive an earth/ground pin are provided. The aperture may comprise a slot, or more than on aperture to cater for various ground pin locations or configurations. Normally the aperture(s) that correspond to the ground pin would be located between apertures adapted to receive pins that are electrically active and/or neutral. The aperture(s) that correspond to the ground pin may be perpendicularly disposed from the midpoint between the apertures adapted to receive pins that are electrically active and/or neutral.

Preferably, the five pairs of 'ground' contacts will be provided that are arranged to receive and electrically engage with different shaped and/or configured ground pins. Alternatively, a single larger pair of contacts may be provided that is adapted to receive and electrically engage with different shaped and/or configured ground pins. Each pair of ground contacts are preferably symmetrically opposed. Preferably all of the ground contacts are electrically connected. The ground contacts may be sprung, but are preferably not sprung. The ground contacts are preferably resilient and shaped to be slightly smaller than the pin being received therein, such that when a ground pin is inserted it engages with the sides of the relative ground contacts and electrically engages therethrough. When the ground pin is removed, the relative ground contacts preferably resiliently return back to substantially their original position. In a preferred form, the contact(s) adapted to receive and electrically engage with different shaped and/or configured ground pins will comprise one or more pairs of contact members being spaced apart at the narrowest point by approximately 1 mm and spaced apart at the widest portion by approximately 6 mm.

Preferably the power socket is adapted to receive, and electrically engage with, many standard AC power plug arrangements. Even more preferably, the power socket is adapted to receive, and electrically engage with, at least 9 different power plug arrangements which preferably includes one or more standard AC power plug types 'A' to 'M' (e.g. standard AC power plugs from Australia/New Zealand, the US, European countries, Japan, India, etc).

The housing preferably has shaped chambers (internally) that holds the contacts and spring therein. Preferably hollowed portions are provided to receive the spring(s). In order to provide a hollowed portion for a spring near a wall of the housing, the housing may have a hollowed portion that protrudes externally. It will be appreciated that the size of the hollowed portion that produces externally will relate to the size of the spring and, therefore, it is preferable that a suitable sized spring is chosen so that any external protrusion is minimised or obviated. In a preferred form, the hollowed portion(s) are approximately 8 mm long and 4.2 mm wide.

The side of the housing with apertures is preferably substantially rectangular with external dimension of less than 50 mm by 50 mm. In a preferred form, the housing has a square portion of approximately 38 mm×38 mm with two 8 mm protrusions.

The power socket may be adapted to conduct AC or DC power, and accordingly be adapted to receive plugs suitable for conducting AC and/or DC power. Alternatively, the socket may facilitate other types of electrical connectivity such as, for example, digital or analogue electrical signals.

The contacts are preferably made of a conductive material with a low resistance such as, for example, copper or brass. The springs may be made of any suitable material, but preferably a resilient metal will be utilised. The housing is preferably made of an insulating material such as, for example, plastic. The housing may be made by any suitable method but, preferably, the housing is moulded (e.g. injection and moulted). If the housing has any metal portions (e.g. on the exterior) that may be touched by a person when the socket is in use, those metal portions are preferably either electrically isolated from the contacts, or in electrical engagement with only the earth/ground contact(s).

The socket may be adapted to be positioned in a wall, architrave, electrical faceplate, or the like directly. In this embodiment, the housing preferably has mounting means for positioning and affixing the socket in the appropriate location. Alternatively, the socket may comprise pins for insertion in to an existing electrical socket as an adapter. In this embodiment, the socket may facilitate the connection of a plug of one type or pin configuration, in to a socket or a different type or pin configuration by being placed therebetween. The pins of the socket may be located on a side of the socket that is different to the side with the apertures. Preferably, the pins of the socket are on the opposite side to the apertures.

Preferably, the housing will be adapted for the particular purpose and/or nature of the socket. For example, the housing may be adapted to substantially enclose the other constituents of the socket (except for any external pins, if provided) in a standalone adapter embodiment, or the housing may provide a faceplate and/or a chassis for holding the socket constituents in an in-wall embodiment.

In order that the invention may be more readily understood and put into practice, one or more embodiments thereof will now be described, by way of example only, with reference to the accompanying drawings.

DESCRIPTION OF PREFERRED EMBODIMENT(S)

Figure 1:
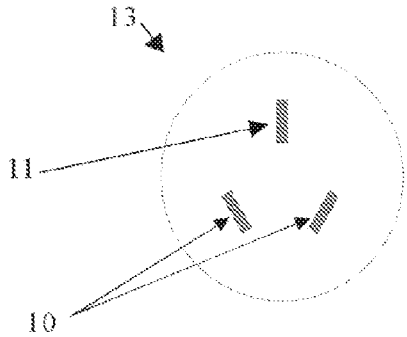
FIGURE 1 (Prior art)
FIG. 1 illustrates a diagrammatic view of a known pin arrangement for a type 'I' power plug.
Figure 2:
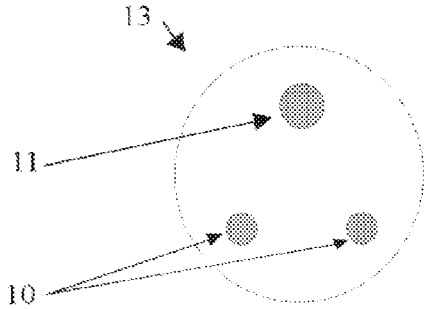
FIGURE 2 (Prior art)
FIG. 2 illustrates a diagrammatic view of a known pin arrangement for a type 'D' power plug.
Figure 3:
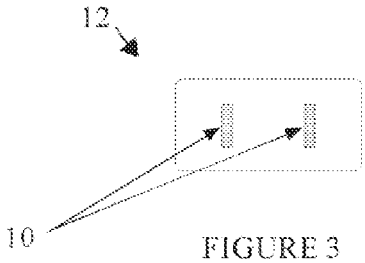
FIGURE 3 (Prior art)
FIG. 3 illustrates a diagrammatic view of a known pin arrangement for a type 'A' power plug.
Figure 4:
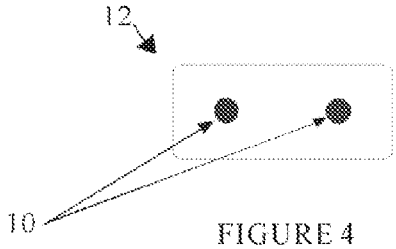
FIGURE 4 (Prior art)
FIG. 4 illustrates a diagrammatic view of a known pin arrangement for a type 'C' power plug.
Figure 5:
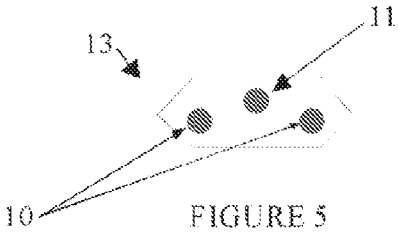
FIGURE 5 (Prior art)
FIG. 5 illustrates a diagrammatic view of a known pin arrangement for a type 'J' power plug.
Figure 6:
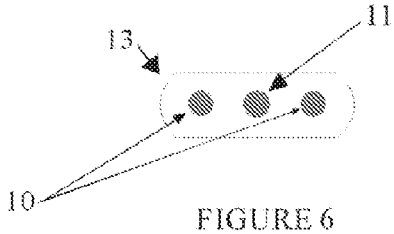
FIGURE 6 (Prior art)
FIG. 6 illustrates a diagrammatic view of a known pin arrangement for a type 'L' power plug.
Figure 7:
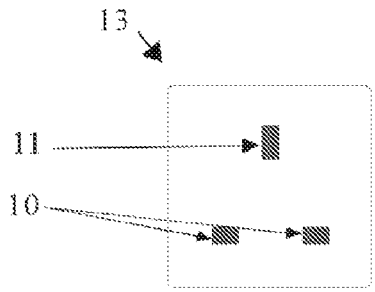
FIGURE 7 (Prior art)
FIG. 7 illustrates a diagrammatic view of a known pin arrangement for a type 'G' power plug.
Figure 8:
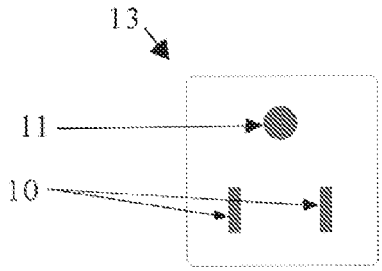
FIGURE 8 (Prior art)
FIG. 8 illustrates a diagrammatic view of a known pin arrangement for a type 'B' power plug.
Figure 9:
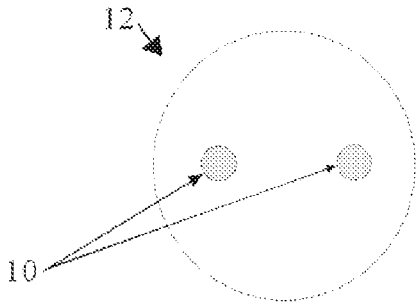
FIGURE 9 (Prior art)
FIG. 9 illustrates a diagrammatic view of a known pin arrangement for a type 'E/F' power plug.
Figure 10:
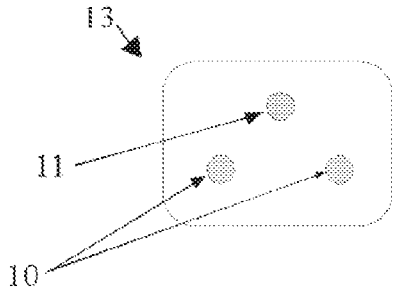
FIGURE 10 (Prior art)
FIG. 10 illustrates a diagrammatic view of a known pin arrangement for a type 'H' power plug.
Figure 11:
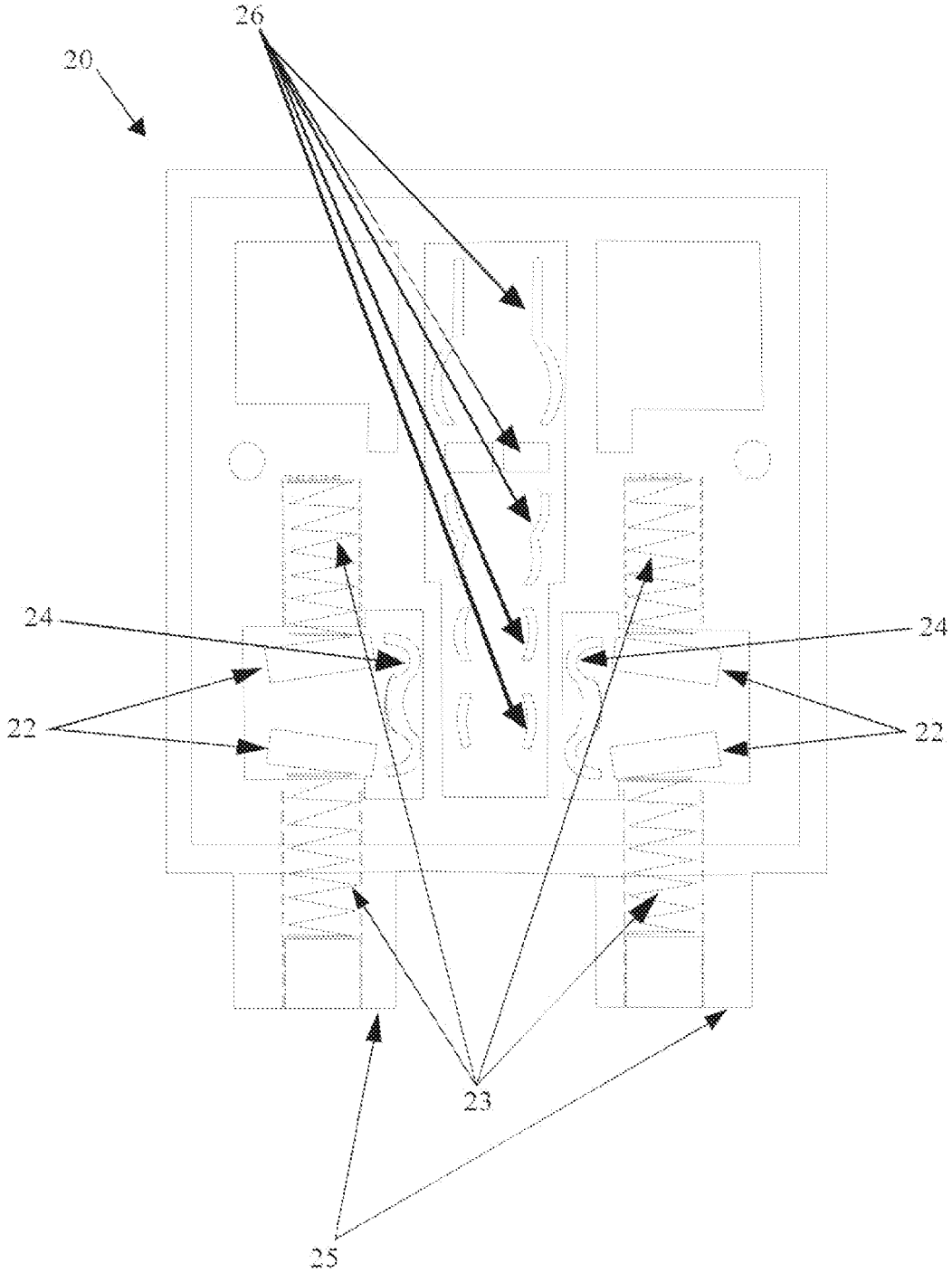
FIG. 11 illustrates a schematic cross section view of a preferred embodiment of the invention.

FIGS. 1 to 10 illustrate various pin configurations for power plugs utilised in different countries and regions around the world. Some of the configurations are for two pin plugs 12, such as illustrated in FIGS. 3, 4 and FIG. 9; and some of the configurations are for three pin plugs 13, such as illustrated in FIGS. 1, 2, 5 to 8, and 10. In the two pin plugs configurations, one of the pins is normally 'active' or 'live' and the other a 'neutral' or 'return'. Essentially the live contact carries current from the source to the load and the neutral returns current to the source.

As the power supply is typically alternating current (AC), the polarity of the two active/natural pings 10 is often not considered essential. Accordingly, the illustrated two pin power plugs 12 (see FIGS. 3, 4, and 9) can be inserted into a corresponding socket in two different ways. In three pin plugs 13, the third pin is typically an 'earth' or 'ground' pin 11. The ground pin provides additional safety and protection, and in particular protects against insulation failure of the connected apparatus (e.g. electrical appliance or device). Most three pin plugs 13 are polarised, but not all of them (e.g. the pin layout illustrated in FIG. 6).

Having polarised plugs is preferred, so that power switches can assuredly switch the active wire in and off, instead of the neutral wire. If the neutral wire is switched instead, the connected apparatus would result in the circuit still being at a live potential, even when off. Although the apparatus itself would not function (due to the lack of a complete circuit), the increased electrical potential would mean a person may get a shock if they came in to contact with the higher potential. Nevertheless, pin arrangements and plugs/sockets have developed around the world with different designs and characteristics. Not only is the arrangement of the pins 10 and/or 11 different between different plug/socket types, but the pins themselves are different sizes and shapes.

The power socket 20 of the present invention advantageously can receive numerous different types of pin shapes and configurations, while maintaining a safe and secure electrical engagement with each of the pins and, in particular, with the active and neutral pins 10. The power socket 20 has a housing 21 that has apertures for receiving pins of a power plug therein. The apertures align generally with contacts that are associated with each aperture. The contacts electrically engage with the respective pin being received therein. In the illustrated embodiment, two sets of sprung contacts are provided, each comprising two contact plates 22 each engaged with a helical spring member 23, and a shaped contact plate 24.

The housing 21 has hollowed recess portions adapted to receive at least a portion of the helical spring members 23, as illustrated. As the apertures and set of contacts are near one side of the housing, a protrusion 25 is provided in the housing (for each set of sprung contacts) that is hollowed to receive the lowermost spring member 23. It is envisaged that if a shorter spring member 23 was provided, or if the housing was shaped differently, that the protrusion in the housing could be reduced or removed.

The helical spring member 23 resilient springs longitudinally to allow the engaged contact plate 22 to resiliently move away from the opposing contact plates. In particular, when a pin 10 or 11 is inserted in the aperture and to the contacts therethrough, the contact plates 22, which are preferably normally located with a distance slightly less than the outer diameter of a pin, are pushed apart by the pin therein, and held in a tight, secure, electrical engagement with the pin by the helical spring members 23 which result in a force being applied substantially perpendicularly to the pin via the contact plates 22. Although two sprung contact plates 22 are illustrated for each set of sprung contacts, it will be appreciated that a single sprung contact, preferably with a suitable opposing surface, could also be utilised. However, such a configuration would likely result in a less secure engagement between the pin and the set of contacts.

The size, shape, and spacing of the sprung contact plates 22, in combination with the side contact plate 24 is adapted to receive and securely electrically engage with a variety of pin shapes inserted therein. The side contact plate 24 has two arced or curved portions which can receive at least an edge of a pin therein (e.g. an angled pin), and a flat middle portion between the curved portions that can electrically engage a flat surface such as the side of a pin (e.g. a straight pin). Although the side contact plate 24 has two curved portions, depending on the pin configurations required to be received, a single curved portion may be all that is required.

Figure 13:
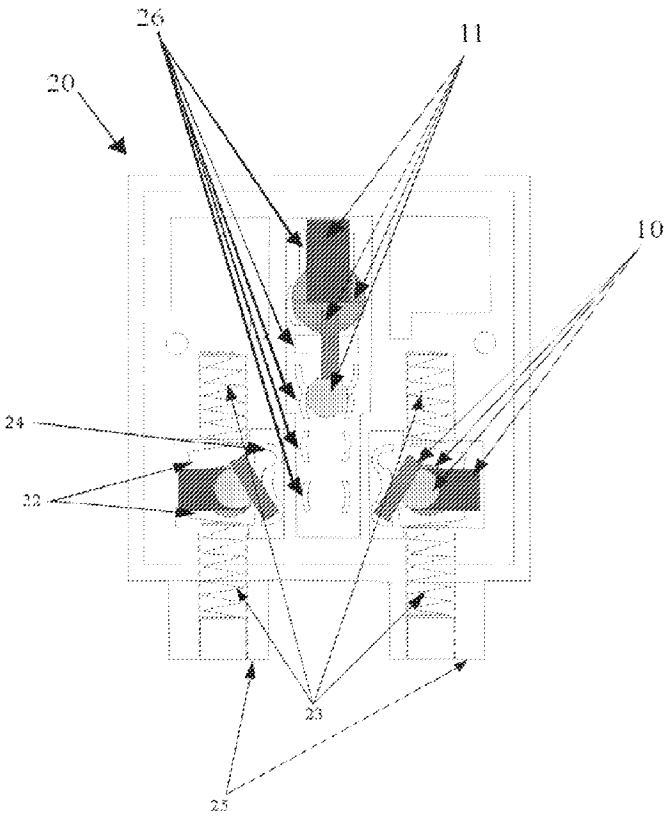
FIG. 13 illustrates a schematic cross section view of a preferred embodiment of the invention with various pin arrangements illustrated therein.
Figure 12:
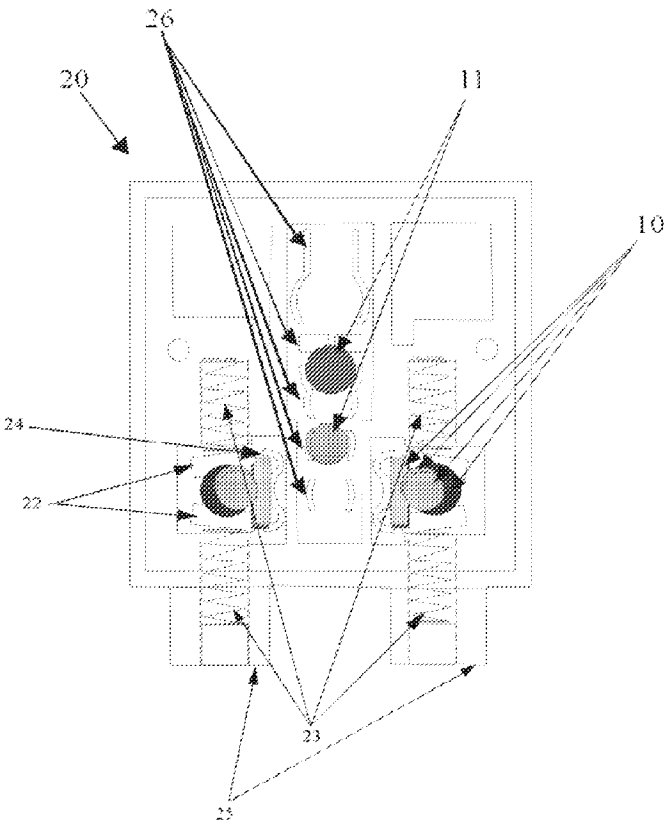
FIG. 12 illustrates a schematic cross section view of a preferred embodiment of the invention with various pin arrangements illustrated therein.
Figure 14:
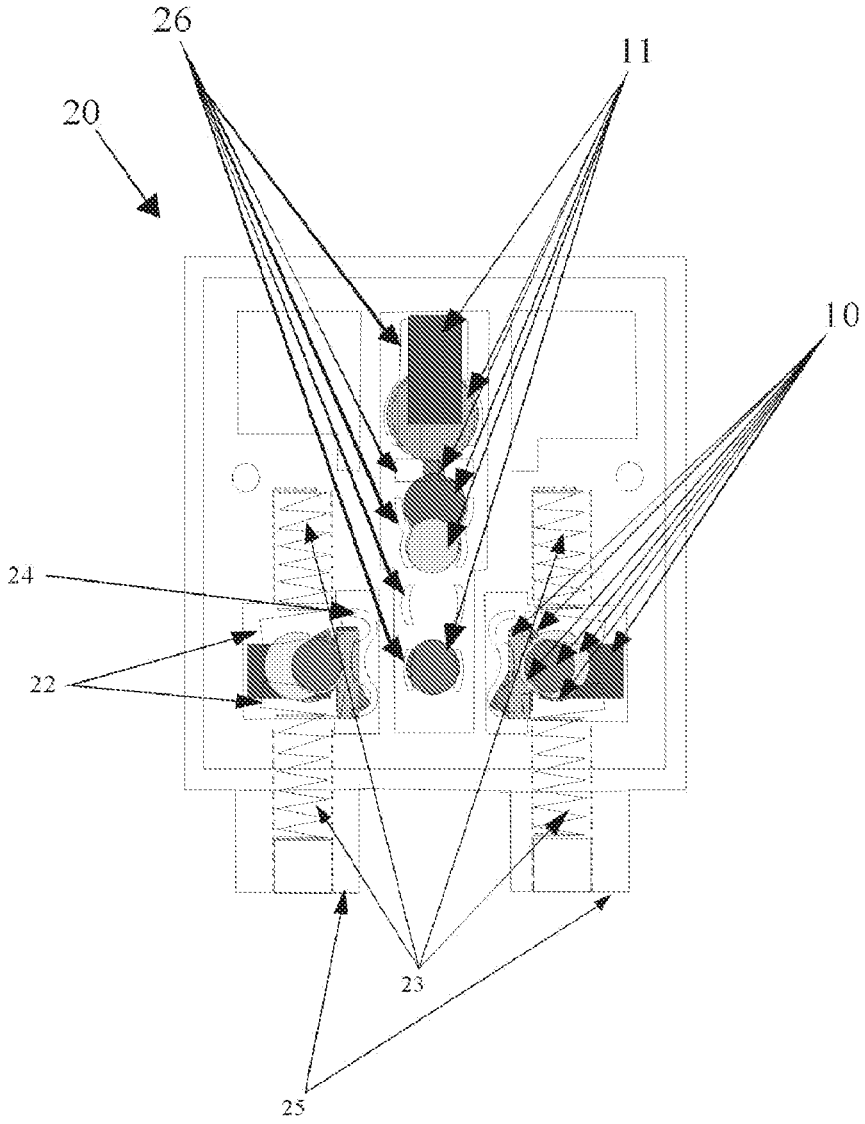
FIG. 14 illustrates a schematic cross section view of a preferred embodiment of the invention with various pin arrangements illustrated therein.

As illustrated in FIGS. 12 to 14, many different pin shapes and sizes can be inserted and electrically connected with at least two of the contact plates 22, 24. When a pin is inserted, the sprung contact plates 22 are pushed aside to allow the pin therein. Notably, the contacts themselves are not bent at any time as the movement is provided by the helical spring member 23. In this regard, as the helical spring member 23 pushes the contact plate 22 onto the pin, a good electrical connection is formed and, therefore the probability of poor contact or arcing occurring is minimised.

The socket 20 also has a set of contacts for receiving a third, earth pin. The earth contacts 26 in the illustrated embodiment comprise five pairs of symmetrical contacts (it is envisaged that only a pair of (or even a single), earth contact could be utilised instead of five pairs). The earth contacts 26 are shaped to suit the various shaped and sized earth pins at their respective locations relative to the sprung contacts 22. The earth contacts 26 may be spring in a similar manner to the sprung contacts 22. However, with the primary plug types/configurations used around the world (e.g. those illustrated in FIGS.

1 to 10), the earth pins are located differently such that with specifically shaped earth contacts 26 it is not necessary for the earth contacts 26 to be moved, either by bending or by being sprung. As illustrated in FIGS. 12 to 14, the particular arrangement of earth contacts 26 can receive the different shaped earth pins 11 for secure electrical (and physical) engagement.

In the illustrated embodiment, the five pairs of symmetrical contacts comprise two arced or curved contacts for receiving round pins therein (e.g. earth pins as illustrated in FIGS. 12 and 14), one double arced or double curved contact for receiving closely positioned (but slightly different sized) pins (e.g. earth pins as illustrated in FIG. 14), one 'slit' contact for receiving a generally straight/flat pin (e.g. earth pin as illustrated in FIG. 13), and a pair of contacts with a curved portion and a straight portion extending therefrom for receiving both a relatively large round pin in the curved portion and a relatively large square pin (e.g. earth pins as illustrated in FIGS. 13 and 14).

In one form, the socket 20 may be a wall socket, or the like. For example it may be used in place of the country/regions type of plug configuration. Advantageously, because he contacts 22, 26 will always electrically engage securely with any type of pin therein, even small pins after large pins have previously been inserted, the socket 20 of the present invention has increased safety and may meet requisite safety standards for daily and/or industrial use. Furthermore, the socket 20 may be produced as a wall socket for use any all and any country/region, regardless of the 'standard' type of plug being employed there presently. In any event, it is envisaged that the socket 20, used as a wall socket, would be particularly useful in airports and hotels, where people with devices/appliances from other regions are likely to be wanting to use a power socket. The socket 20 of the present invention, when used as a standard wall socket, would eliminate the need for the user to have to carry and/or use an adapter, such as a 'universal' adapter.

Alternatively, the socket 20 of the present invention may be used as a safe universal adapter that can safely receive and electrically (and physically) engage with a plurality of different plug types, and then be plugged in to a standard wall socket (presumably of the country/regions type). In this embodiment, the socket 20 has pins (not illustrated) that are preferably located opposite pin receiving side of the housing.

It is to be understood that the terminology employed above is for the purpose of description and should not be regarded as limiting.

The foregoing embodiments are intended to be illustrative of the invention, without limiting the scope thereof. The invention is capable of being practised with various modifications and additions as will readily occur to those skilled in the art.

Throughout this specification, including the claims, where the context permits, the term "comprise" and variants thereof such as "comprises" or "comprising" are to be interpreted as including the stated integer or integers without necessarily excluding any other integers.

The claims defining the invention are as follows:

1. A power socket adapted to receive power plugs with different pin configurations, the power socket comprising:

a housing having at least two apertures for receiving respective pins of the power plug therein;

a contact associated with each aperture that electrically engages with the respective pin; and a spring configured to apply force to the at least one contact such that the at least one contact applies force substantially perpendicularly to the longitudinal axis of the respective pin.

* * * * *